US006139388A

United States Patent [19]

Mok et al.

[11] Patent Number: 6,139,388

[45] Date of Patent: Oct. 31, 2000

[54] METHOD OF FORMING A FRIT SEAL BETWEEN A STEM AND A NECK OF A CATHODE RAY TUBE DURING MANUFACTURING OF A CATHODE RAY TUBE

[75] Inventors: Young-kyun Mok; Jae-kon Lee; Jong-koo Park, all of Kyungki-do, Rep. of Korea

[73] Assignee: Samsung Display Devices Co., Ltd., Kyungki-do, Rep. of Korea

[21] Appl. No.: 09/121,281

[22] Filed: Jul. 22, 1998

[30] Foreign Application Priority Data

Jul. 22, 1997 [KR] Rep. of Korea ..... 97-34171

[51] Int. Cl.[7] ..... H01J 9/12; H01J 9/26; H01J 9/06; H01J 9/10; H01J 9/16

[52] U.S. Cl. ..... 445/34; 445/45; 445/67

[58] Field of Search ..... 445/34, 45, 67; 313/451, 318.01, 318.05, 318.08, 477 HC

[56] References Cited

U.S. PATENT DOCUMENTS 4,066,310 1/1978 Palac ..... 316/19
4,608,516 8/1986 Oki ..... 313/477 R
5,818,155 10/1998 Kawamura et al. ..... 313/318.05
5,898,264 4/1999 Nose et al. ..... 313/477 HC

FOREIGN PATENT DOCUMENTS 883582 3/1996 Japan .

*Primary Examiner*—Nimeshkumar D. Patel
*Assistant Examiner*—Michael J. Smith
*Attorney, Agent, or Firm*—Christie, Parker & Hale, LLP

[57] ABSTRACT

A method of manufacturing a cathode ray tube comprising the steps of providing a stem with a flange having an outer diameter larger than an inner diameter of a bottom end of a neck and smaller than or identical with an outer diameter of the bottom end of the neck, applying a liquefied frit glass onto an upper portion of the flange, hardening the liquefied frit glass applied on the upper portion of the flange, mounting an electron gun onto the stem, fitting the stem into the inside of the neck such that the upper portion of the flange applied with the frit glass contacts a bottom end of the neck, and providing a frit seal between the upper portion of the flange and the bottom end of the neck by heat-treating the frit glass between them.

3 Claims, 5 Drawing Sheets

METHOD OF FORMING A FRIT SEAL BETWEEN A STEM AND A NECK OF A CATHODE RAY TUBE DURING MANUFACTURING OF A CATHODE RAY TUBE

CROSS REFERENCE TO RELATED APPLICATION

This application claims priority to Korean patent application No. 97-34171, filed Jul. 22, 1997, the content of which is incorporated hereinto by reference.

BACKGROUND OF THE INVENTION (a) Field of the Invention

The present invention relates to a method of manufacturing a cathode ray tube (CRT) and a heating device for use in the CRT manufacture and, more particularly, to a method of forming a frit seal between a stem and neck of the CRT, minimizing defects of the CRT such as oxidization of an electron gun and stem pins, deterioration in the electron emission efficiency, shortage in the life span and occurrence of a crack of the CRT.

(b) Description of the Related Art

Generally, CRTs are designed to reproduce the original picture image on a screen through receiving the picture image signals from the external and exciting phosphors coated on the screen with electron beams in accordance with the signals. The CRT usually includes a panel having an inner surface coated with phosphors, a funnel sealed to the panel in a vacuum-tight manner, and a neck sealed to the rear of the funnel to accommodate an electron gun therein.

The electron gun is mounted on a stem to receive currents for emitting, focusing and accelerating thermal electrons therefrom. The stem is fitted into the neck and firmly sealed to it.

FIG. 8 shows a sealing state of the stem S to the neck N according to a prior art. The stem S is first inserted into the neck N. Then, the outer surface of the neck N adjacent to the flange of the stem S is fused to form a seal therebetween and the remaining end portion of the neck N is removed.

However, when the end portion of the neck N is cut off or drops to be broken to pieces, fine glass powder is generated.

The glass powder wanders through the factory and intrudes into the inside of the CRT through the exhaust pipe externally attached to the stem or through the opening portion of the neck before the sealing operation. As a result, it clogs beam-guide holes formed on a shadow mask of the CRT. This causes a serious defect in the CRT. Furthermore, since the remaining end portion of the neck is cut off and waste-disposed after the sealing operation, a minus effect is resulted in the production costs.

Another conventional method of sealing the stem to the neck is disclosed in a Japanese Patent Laid Open No. 8-83582. In the method, a bottom end of the neck is positioned on an upper portion of the flange of the stem and fused to form a seal therebetween.

However, there is a gap between the bottom end of the neck and the upper portion of the flange because they do not practically make a uniform contact side. And when the fusing operation is performed onto the gapped contact side by a heating device such as a torch, the torch flame penetrates into the inside of the neck through the gap. As a result, the electrodes of the electron gun and the stem pins are oxidized so that the electron emission efficiency is deteriorated. Furthermore, the temperature of the torch flame is extremely high and, hence, a distortion defect is generated in the neck glass, causing a crack.

SUMMARY OF THE INVENTION

It is an object of the present invention to provide a method of forming a frit seal between a neck and stem of a CRT and a heating device for use in the CRT manufacture, minimizing various defects of the CRT.

In order to achieve this and other objects, the method of forming a frit seal between the stem and neck of the CRT includes the steps of providing a stem with a flange having an outer diameter larger than an inner diameter of a bottom end of a neck and smaller than or identical with an outer diameter of the bottom end of the neck, applying a liquefied frit glass onto an upper portion of the flange, hardening the liquefied frit glass applied on the upper portion of the flange, mounting an electron gun onto the stem, fitting the stem into the inside of the neck such that the upper portion of the flange applied with the frit glass contacts the bottom end of the neck, and heat-treating the frit glass between the upper portion of the flange and the bottom end of the neck to form a frit seal.

The heating device for use in the CRT manufacture includes a stem holder for rigidly holding a stem, a first heater provided on the upper portion of the stem holder to heat the bottom end of a neck and the upper portion of a flange of the stem, and a second heater positioned below the first heater to heat an exhaust pipe of the stem.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, wherein.

DETAILED DESCRIPTION OF THE INVENTION

Reference will now be made in detail to the preferred embodiment of the present invention, examples of which are illustrated in the accompanying drawings.

Figure 2:
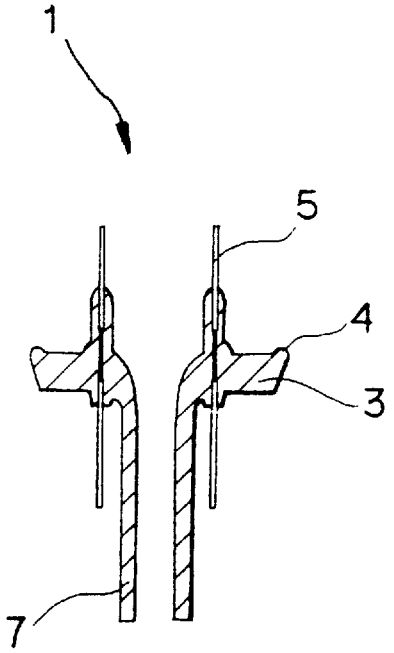
FIG. 2 is a cross sectional view of a stem illustrating a flange providing step according to the preferred embodiment.

FIG. 2 is a cross sectional view of a stem according to a preferred embodiment of the present invention. As shown in FIG. 2, the stem 1 includes an exhaust pipe 7 for exhausting air from the inside of the CRT to the outside.

The stem 1 includes a plurality of pins 5 for supplying electric current to an electron gun 15, a flange 3 having an outer diameter larger than the inner diameter of a neck 19 but smaller than or identical with the outer diameter of the neck 19, and a flow stopper 4 protruded along the upper periphery of the flange 3.

Figure 3:
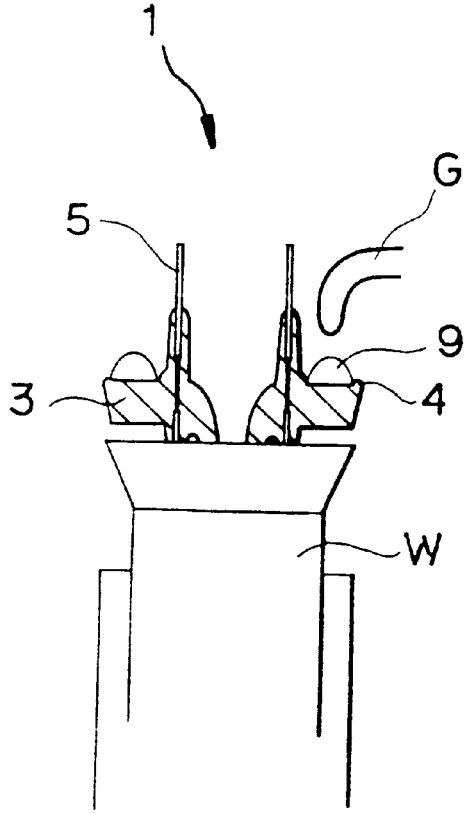
FIG. 3 is a view illustrating a frit glass applying step according to the preferred embodiment.

As shown in FIG. 3, a liquefied frit glass 9 is fed onto the upper portion of the flange 3 by a gun G and stopped by the flow stopper 4.

At this time, the stem 1 is preferably rotated with a predetermined velocity by inserting the exhaust pipe 7 onto the shaft of a rotary machine W so that the liquefied frit glass 9 can be uniformly applied onto the upper portion of the flange 3.

Meanwhile, the high-temperature frit glass 9 applied on the upper portion of the flange 3 is exposed to the atmosphere and, as a result, it is naturally cooled and hardened at a room temperature. However, at this time, fine glass powder is easily produced. This glass powder has bad effects such as a beam-guide hole-clogging defect of a shadow mask on the CRT manufacturing process. Furthermore, since the hardened frit glass 9 is easily broken to pieces, the worker should carefully treat it.

In order to avoid the above problems, it is required that the hardened frit glass 9 should pass through a process of heating it above a softening point and again slowly cooling it down to a transition point.

In this process, the fused frit glass 9 should be slowly cooled down to the transition point. When the fused frit glass 9 is rapidly cooled at a temperature above the transition point, it is liable to be distorted, causing a crack. In contrast, this bad effect is not generated at a temperature below the transition point, even in the rapid cooling operation.

Figure 4:
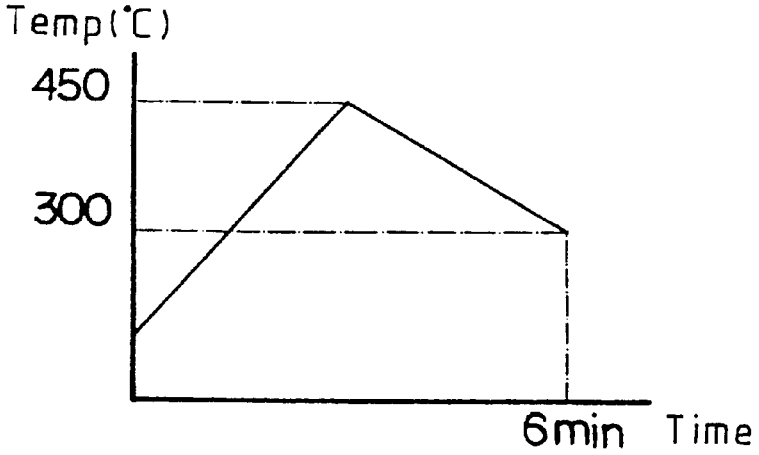
FIG. 4 is a graph showing a temperature curve of the frit glass in a frit glass hardening step according to the preferred embodiment.

The softening and transition points can be varied in accordance with the characteristics of the frit glass 9. But as shown in FIG. 4, the aforementioned process takes about six minutes in heating up to 450° C. and slowly cooling up to 300° C. because the frit glass 9 has the softening point of about 390° C. and the transition point of 300° C. The reason that the frit glass 9 should be heated up to 450° C. is because it can be completely fused by that temperature.

Likewise, the time taken for the process can be also varied in accordance with the characteristics of the frit glass 9.

The frit glass 9 passing through the aforementioned process does not produce a glass powder and can be hardened without brittleness.

Figure 5:
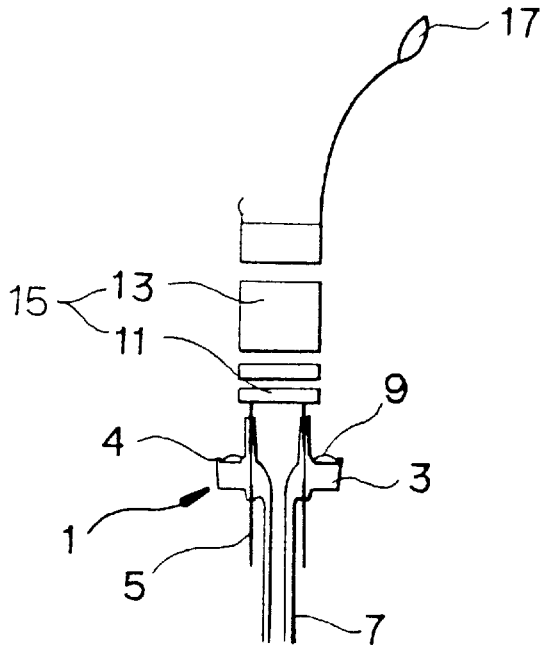
FIG. 5 is a view illustrating an electron gun mounting step according to the preferred embodiment.

As shown in FIG. 5, the stem 1 mounts an electron gun 15 thereon. The electron gun 15 includes a heater-cathode portion 11 for generating a heat to thereby emit thermal electrons, and a lens portion 13 for focusing and accelerating the thermal electrons. In addition, a getter 17 is attached on one side of the electron gun to remove the last traces of a gas when reached a high vacuum.

Figure 1:
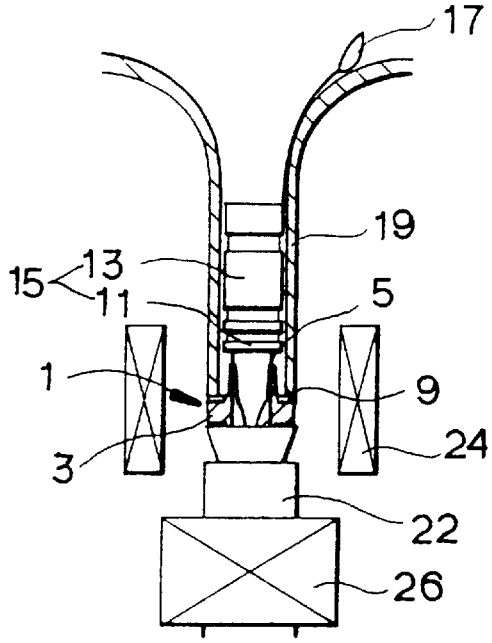
FIG. 1 is a schematic sectional view of a neck portion of a CRT illustrating a frit seal formation process according to a preferred embodiment of the present invention.

The stem 1 mounting the electron gun 15 thereon is bonded together with the neck 19 in a manner as to provide a vacuum-tight seal between them, using a liquefied frit glass 9 as the adhesive material. For that purpose, as shown in FIG. 1, a bulb, in which the panel, funnel and neck are sequentially sealed together, is fixed on a bulb fixation equipment (not shown) such that an opening portion of the neck 19 faces the ground. Thereafter, the lower portion of the flange 3 of the stem 1 is inserted into a stem holder 22 which is placed coaxial with the opening portion of the neck 19.

As the stem holder 22 is raised toward the opening portion of the neck 19, the electron gun 15 as well as the getter 17 is fitted into the neck 19, and the frit glass 9 hardened on the upper portion of the flange 3 makes in contact with the bottom end of the neck 19.

At this time, the frit glass 9 should be fused so as to provide a frit seal between the neck 19 and the stem 1.

For that purpose, a heating unit is provided adjacent to the frit glass 9. In this preferred embodiment, the heating unit includes a first heater 24 surrounding the end portion of the neck 19 and the upper portion of the flange 3, and a second heater 26 surrounding the exhaust pipe 7 of the stem 1.

Figure 6:
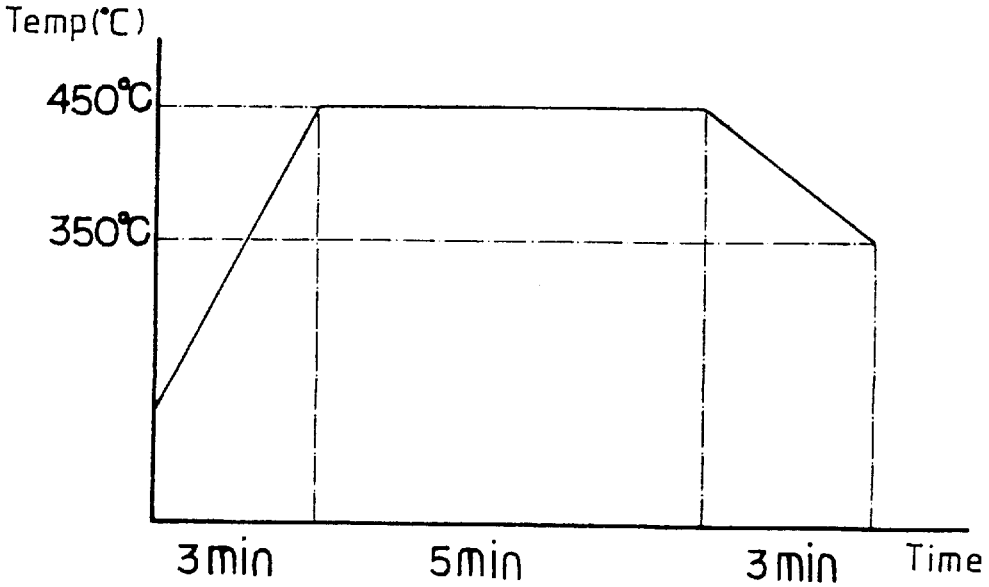
FIG. 6 is a graph showing a temperature curve of the frit glass in a firt seal providing step according to the preferred embodiment.
Figure 7:
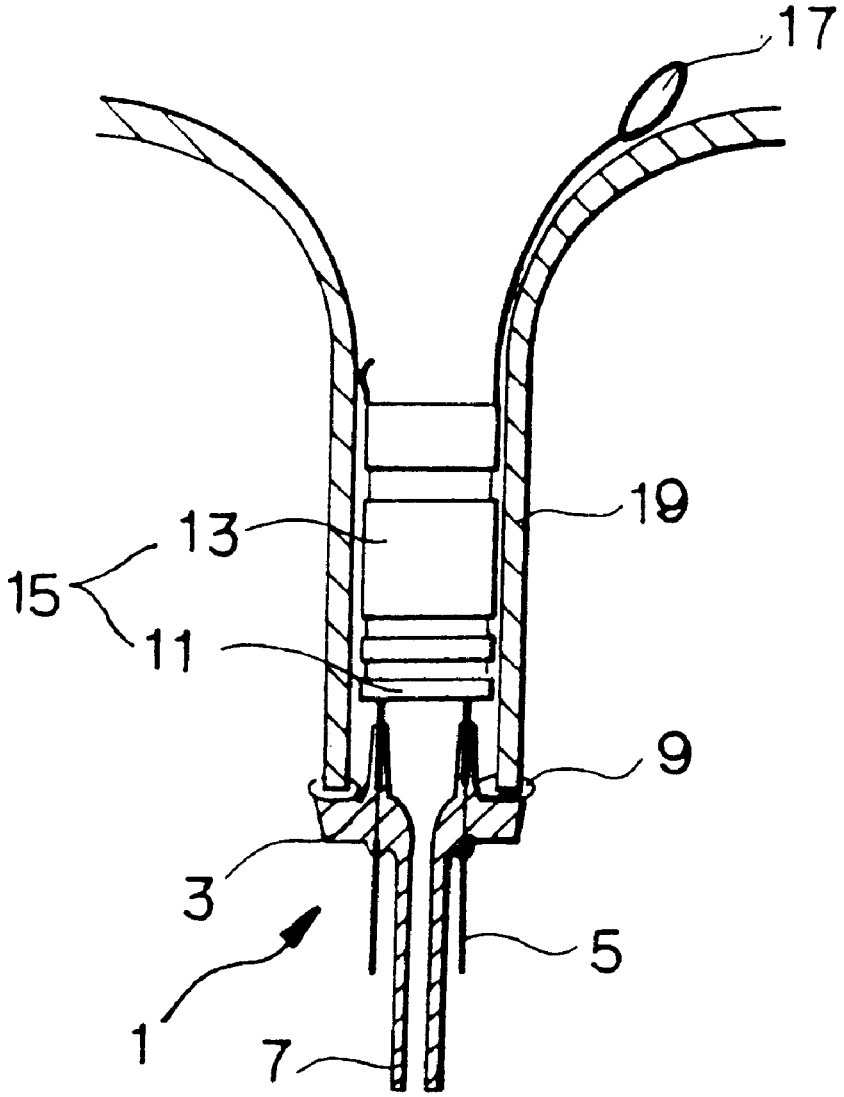
FIG. 7 is a view illustrating a stem fitting step according to the preferred embodiment.
Figure 8:
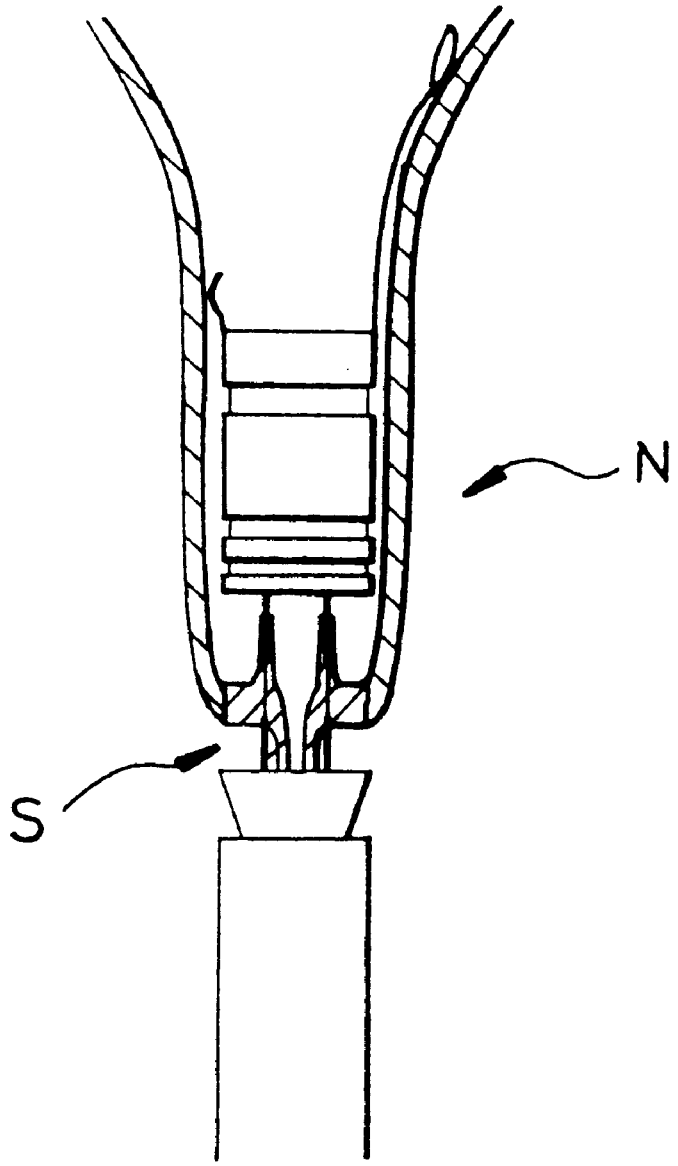
FIG. 8 (Prior Art)
FIG. 8 is a view showing a sealing state of the neck to the stem according to a prior art.

FIG. 6 is a graph showing a temperature curve of the frit glass heated by the heating unit. The frit glass 9 is heated up to 450° C. above the softening point for three minutes and maintained at that temperature for five minutes. Thereafter, it is slowly cooled down to the transition point of 300° C. within three minutes. As a result, as shown in FIG. 7, the sealing operation is completed.

As noted above, the frit glass 9 is maintained at the temperature of 450° C. for five minutes to be completely fused. Accordingly, the fused frit glass 9 can be uniformly permeated onto the contact side between the stem 1 and the neck 19.

Of course, the aforementioned limit temperature and time can be varied in accordance with the characteristics of the frit glass 9.

Among the heaters, the first heater 24 is preferably rotated with a predetermined velocity to uniformly heat the end portion of the neck 19 and the upper portion of the flange 3.

In comparison with the conventional method of forming a seal between the neck and stem by heating the end portion of the neck using a torch, the inventive method of forming a frit seal between the neck 19 and the stem 1 by fusing the frit glass 6 between the bottom end of the neck and the upper portion of the stem has an advantage that deterioration in the electron emission efficiency is prevented by minimizing oxidation of the electron gun 15 and stem pins 5 through fusing the frit glass 9 at a lower temperature, that is, to the utmost 450° C.

Furthermore, in the present invention, the torch which emits a high-temperature flame is not used but a low-temperature heating unit is used for the fusing purpose so that the distortion defect, causing a crack, is not generated.

In addition, even when the CRT manufactured by the inventive method is found to be defective, the frit glass 9 is easily removed using a weak nitric acid and cleaning water so that the salvaged components can be reintroduced into the suitable step of the CRT manufacturing process.

Moreover, since the end portion of the neck 19 is not needed to be cut off, the production costs can be reduced and the beam-guide hole clogging defect of the shadow mask, occurring due to the powdered glass produced when the discarded neck portion is broken into pieces, can be prevented.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A method of manufacturing a cathode ray tube having a neck, comprising the steps of:

providing a stem with a flange having an outer diameter larger than an inner diameter of an end of the neck and smaller than or equal to an outer diameter of the end of the neck; wherein the stem comprises a flow stopper protruding from a periphery of a surface of the flange;

applying a liquefied frit glass onto a surface of the flange;

hardening the liquefied frit glass applied on the surface of the flange;

mounting an electron gun onto the stem;

fitting the stem inside of the neck such that the surface of the flange applied with the frit glass contacts the end of the neck; and forming a frit seal between the surface of the flange and the end of the neck by heat-treating the frit glass between the surface of the flange and the end of the neck.

2. A method of manufacturing a cathode ray tube having a neck, comprising the steps of:

providing a stem with a flange having an outer diameter larger than an inner diameter of an end of the neck and smaller than or equal to an outer diameter of the end of the neck;

applying a liquefied frit glass onto a surface of the flange;

hardening the liquefied frit glass applied on the surface of the flange;

mounting an electron gun onto the stem;

fitting the stem inside of the neck such that the surface of the flange applied with the frit glass contacts the end of the neck; and forming a frit seal between the surface of the flange and the end of the neck by heat-treating the frit glass between the surface of the flange and the end of the neck;

wherein the step of hardening the liquefied frit glass comprises heating the frit glass up to a temperature above a softening point of the frit glass and cooling the frit glass down to a transition point of the frit glass; and wherein the temperature does not exceed 100° C. above the softening point of the frit glass.

3. A method of manufacturing a cathode ray tube having a neck, comprising the steps of:

providing a stem with a flange having an outer diameter larger than an inner diameter of an end of the neck and smaller than or equal to an outer diameter of the end of the neck;

applying a liquefied frit glass onto a surface of the flange;

hardening the liquefied frit glass applied on the surface of the flange;

mounting an electron gun onto the stem;

fitting the stem inside of the neck such that the surface of the flange applied with the frit glass contacts the end of the neck; and forming a frit seal between the surface of the flange and the end of the neck by heat-treating the frit glass between the surface of the flange and the end of the neck;

wherein the step of forming a frit seal comprises heating the frit glass up to a temperature above the softening point of the frit glass, keeping the frit glass at the temperature for a predetermined time, and cooling the frit glass down to a transition point of the frit glass; and wherein the temperature does not exceed 100° C. above the softening point of the frit glass.

* * * * *